US008640482B2

(12) United States Patent
Lim et al.

(10) Patent No.: US 8,640,482 B2
(45) Date of Patent: Feb. 4, 2014

(54) REFRIGERATOR HAVING FOLDING SHELF

(75) Inventors: Jae Hoon Lim, Suwon-si (KR); Jong Dal Lee, Gwangju (KR); Myung Hoon Cho, Suwon-si (KR); Seung Tae Lim, Gwangju (KR); Dong Nyeol Ryu, Daejeon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 672 days.

(21) Appl. No.: 11/882,583

(22) Filed: Aug. 2, 2007

(65) Prior Publication Data

US 2008/0034778 A1 Feb. 14, 2008

(30) Foreign Application Priority Data

Aug. 11, 2006 (KR) ..... 10-2006-0076433
May 25, 2007 (KR) ..... 10-2007-0050709

(51) Int. Cl.
*F25C 1/22* (2006.01)

(52) U.S. Cl.
USPC ..... 62/340; 62/258; 312/408

(58) Field of Classification Search
USPC ..... 62/344, 340, 258; 211/90.01–90.02, 96, 211/136; 312/408
See application file for complete search history.

(56) References Cited

U.S. PATENT DOCUMENTS 1,473,793 A * 11/1923 Mazsick ..... 312/300
2,091,607 A * 8/1937 Nave ..... 211/153
2,266,206 A 12/1941 Jackson et al.
2,517,385 A * 8/1950 Clark ..... 312/323
2,676,864 A * 4/1954 Townsend ..... 312/291
2,992,742 A * 7/1961 Pendergrast, Jr ..... 108/146
5,813,741 A * 9/1998 Fish et al. ..... 312/408
6,055,823 A * 5/2000 Baker et al. ..... 62/265
6,065,821 A * 5/2000 Anderson et al. ..... 312/408
6,474,094 B2 11/2002 Kim
2003/0208881 A1 11/2003 Li
2006/0086131 A1 4/2006 Pastryk et al.
2007/0012637 A1* 1/2007 Yu et al. ..... 211/96
2007/0119193 A1* 5/2007 Davis et al. ..... 62/135

FOREIGN PATENT DOCUMENTS

JP 2003-322465 11/2003

OTHER PUBLICATIONS

U.S. Office Action from copending U.S. Appl. No. 12/457,112 dated Nov. 20, 2012.
U.S. Office Action from copending U.S. Appl. No. 12/457,112 dated May 15, 2012.
U.S. Office Action from copending U.S. Appl. No. 12/457,112 dated Jun. 27, 2013.

* cited by examiner

*Primary Examiner* — Lakiya Rogers
(74) *Attorney, Agent, or Firm* — Staas & Halsey LLP

(57) ABSTRACT

A refrigerator includes an ice maker disposed at one side of a storage chamber for storing food, a folding shelf disposed at the ice maker to be folded in a vertical direction or unfolded in a horizontal direction to efficiently use a space formed on the side of the ice maker, a shelf supporting member fixed to the ice maker to rotatably support the folding shelf, and a locking part disposed at the shelf supporting member to support the folding shelf when the folding shelf is unfolded to be arranged in a horizontal direction. When the folding shelf disposed in the storage chamber is folded in a vertical direction, there is formed a space capable of storing containers or food products having a great height. When the folding shelf is unfolded in a horizontal direction, containers or food products having a small height can be put on the folding shelf.

6 Claims, 11 Drawing Sheets

REFRIGERATOR HAVING FOLDING SHELF

CROSS-REFERENCE TO RELATED APPLICATIONS

This application claims the benefit of Korean Patent Application Nos. 2006-0076433 and 2007-0050709, filed on Aug. 11, 2006 and May 25, 2007, respectively, in the Korean Intellectual Property Office, the disclosure of which is incorporated herein by reference.

BACKGROUND

1. Field

The present invention relates to a refrigerator, and more particularly to a refrigerator including a folding shelf rotatably disposed in the refrigerator such that food, containers and the like can be put on the folding shelf.

2. Description of the Related Art

Generally, a refrigerator includes a cooling chamber for storing various food products and beverages to cool them, a freezing chamber for frozen food products such as meat, fishes and ice cream to freeze them, and a cool air generating device for supplying cool air to the cooling chamber and the freezing chamber. The cool air generating device includes an evaporator for cooling the surrounding air and a fan for forcibly blowing the cooled air.

A plurality of shelves is provided in the cooling chamber and the freezing chamber for supporting various products put thereon. Door baskets are disposed at the inner side of a cooling chamber door and a freezing chamber door to store containers having a small bottom area such as bottles and cans.

Refrigerators for home use may be sorted into a general type refrigerator, a side-by-side type refrigerator, a 3-door type refrigerator and the like according to arrangement of the cooling chamber and the freezing chamber and a door installation structure. The most commonly used general type refrigerator includes a freezing chamber disposed at an upper portion, a cooling chamber disposed under the freezing chamber. The general type refrigerator further includes and a freezing chamber door and a cooling chamber door which are respectively arranged at the upper and lower sides.

The side-by-side type refrigerator includes a freezing chamber and a cooling chamber respectively disposed in the left and right compartments. The side-by-side type refrigerator further includes a freezing chamber door and a cooling chamber door disposed on left and right sides. The side-by-side type refrigerator is appropriate for a large-capacity refrigerator including a large-capacity freezing chamber and a large-capacity cooling chamber. In this case, an ice maker may be disposed in the freezing chamber and a dispenser may be disposed in the freezing chamber door to discharge ice made in the ice maker.

The 3-door type refrigerator includes a freezing chamber and a cooling chamber respectively disposed at lower and upper portions. The freezing chamber is opened or closed by a drawer-type freezing chamber door. The cooling chamber is opened or closed by a pair of cooling chamber doors arranged on left and right sides. In the 3-door type refrigerator, the ice maker is disposed in the cooling chamber and the dispenser is disposed in the cooling chamber door, thereby having an advantage in that water supplied into the ice maker is not frozen compared to the side-by-side type refrigerator including the ice maker disposed in the freezing chamber.

Laid-open Korean Patent Publication No. 10-2005-117536 discloses an example of the 3-door type refrigerator. The 3-door type refrigerator disclosed in the Laid-open Publication includes a cooling chamber disposed at an upper portion of a refrigerator main body, a freezing chamber disposed under the cooling chamber, an ice making chamber defined by an insulating partition in the cooling chamber, a pair of heat exchangers respectively disposed in the cooling chamber and the freezing chamber, and a plurality of shelves disposed in the cooling chamber to support stored food products.

However, in the refrigerator according to the prior art, the ice maker occupies a specified space in the cooling chamber. Accordingly, it is not easy to arrange the shelves to efficiently use a storage space of the cooling chamber. That is, if a shelf is installed next to the ice maker, it is difficult to store products having a great height in the cooling chamber due to the shelf. If the shelf is not installed next to the ice maker, a space formed on the side of the ice maker can be efficiently used, thereby causing problems such as low efficiency of storage space utilization of the cooling chamber.

SUMMARY

The present invention has been made in order to solve the above problems. It is an aspect of the invention to provide a refrigerator including a folding shelf capable of being folded or unfolded from a vertical position to a horizontal position to efficiently use a storage space in a storage chamber, particularly, a storage space formed on the side of the ice maker.

In accordance with an aspect of the invention, there is provided a refrigerator including an ice maker disposed at one side of a storage chamber for storing food, including a folding shelf disposed at the ice maker; a shelf supporting member fixed to the ice maker to rotatably support the folding shelf; and a locking part disposed at the shelf supporting member to support the folding shelf when the folding shelf is unfolded to be arranged in a horizontal direction.

The refrigerator may further include a connecting member disposed at the folding shelf to be hinge-connected to the shelf supporting member.

The refrigerator may further include a shelf fixing device to hold the folding shelf in a folded state.

An insertion groove may be disposed at any one of the ice maker and the folding shelf, and the shelf fixing device is hinge-connected to the other of the ice maker and the folding shelf and includes a hook member having a portion which is inserted into the insertion groove.

A contact device may be disposed between the shelf supporting member and the connecting member while being supported by any one of the shelf supporting member and the connecting member and being contacted to the other of the shelf supporting member and the connecting member to suppress rotation of the connecting member.

The contact device may include a pressing spring which is supported by any one of the shelf supporting member and the connecting member, and a contact member having a contact part which is supported by the pressing spring to be pressed and contacted to the other of the shelf supporting member and the connecting member.

The connecting member may include a receiving groove to receive the pressing spring and the contact member, and the shelf supporting member may include a first locking groove which receives the contact part of the contact member when the folding shelf is folded in a vertical direction and a second locking groove which receives the contact part of the contact member when the folding shelf is unfolded in a horizontal direction.

A fixed shelf may be disposed in the storage chamber such that the folding shelf and the fixed shelf are arranged on the same plane when the folding shelf is unfolded in a horizontal direction.

In accordance with another aspect of the invention, there is provided a refrigerator including a storage chamber for storing food including a shelf supporting member fixed to one side wall surface of the storage chamber; a folding shelf rotatably coupled to the shelf supporting member to be folded in a vertical direction or unfolded in a horizontal direction; a connecting member disposed at the folding shelf to be hinge-connected to the shelf supporting member; and a contact device disposed between the shelf supporting member and the connecting member while being supported by any one of the shelf supporting member and the connecting member and being contacted to the other of the shelf supporting member and the connecting member to suppress rotation of the connecting member.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which FIG. 1 schematically shows a front view of a refrigerator according to one embodiment of the present invention.

DETAILED DESCRIPTION OF THE EMBODIMENTS

Figure 1:
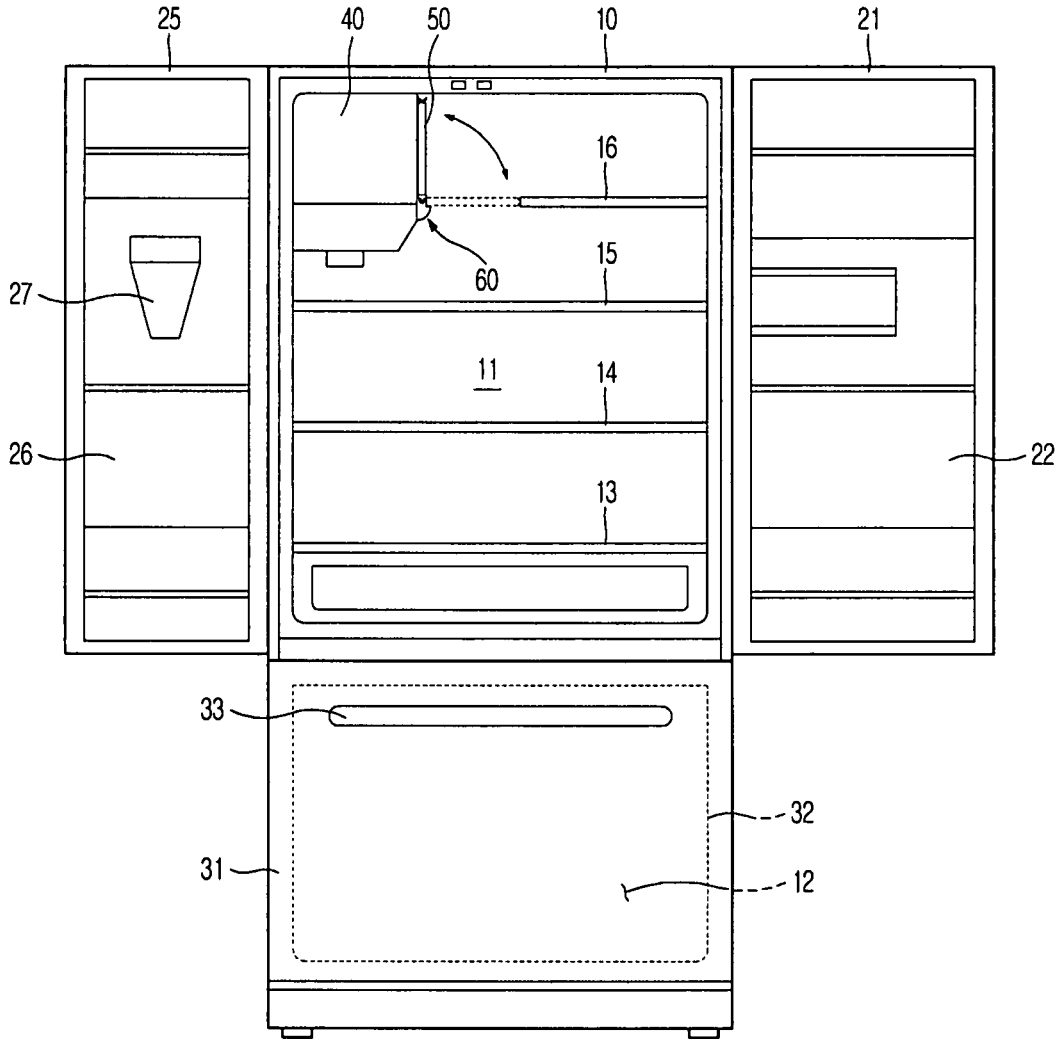

Reference will now be made in detail to exemplary embodiments of the present invention, examples of which are illustrated in the accompanying drawings, wherein like reference numerals refer to like elements throughout. The embodiments are described below to explain the present invention by referring to the figures.

Hereinafter, a refrigerator according to an embodiment of the present invention will be described with reference to accompanying drawings.

Figure 2:
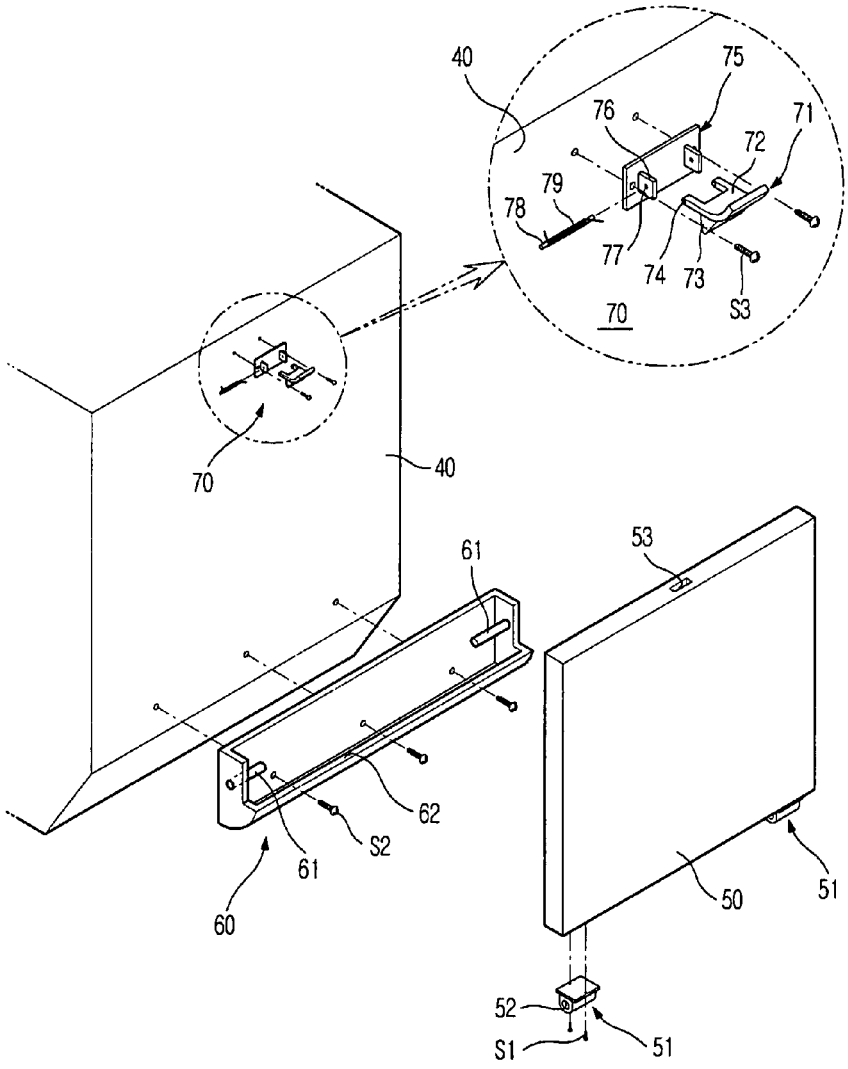
FIG. 2 shows an exploded perspective view of main parts of the refrigerator according to the embodiment of the present invention.
Figure 3:
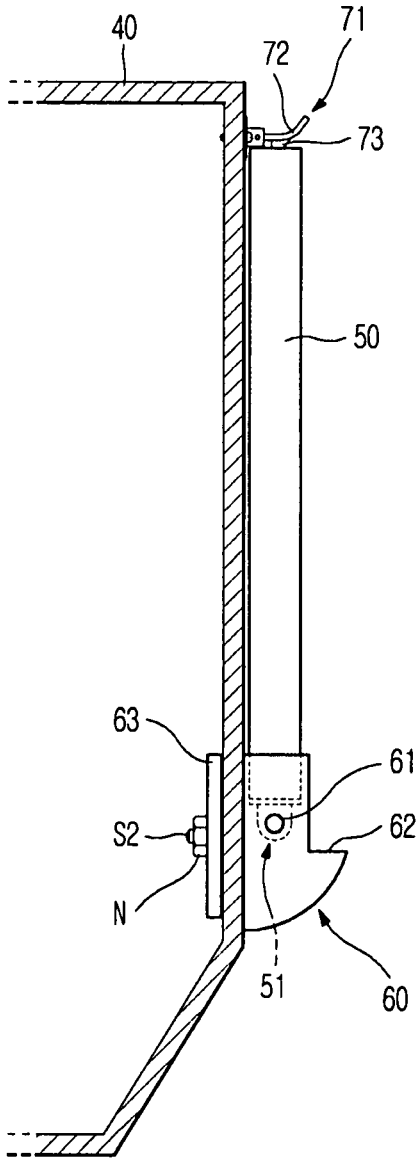
FIGS. 3 and 4 show front views of the main parts of the refrigerator according to the embodiment of the present invention.
Figure 4:
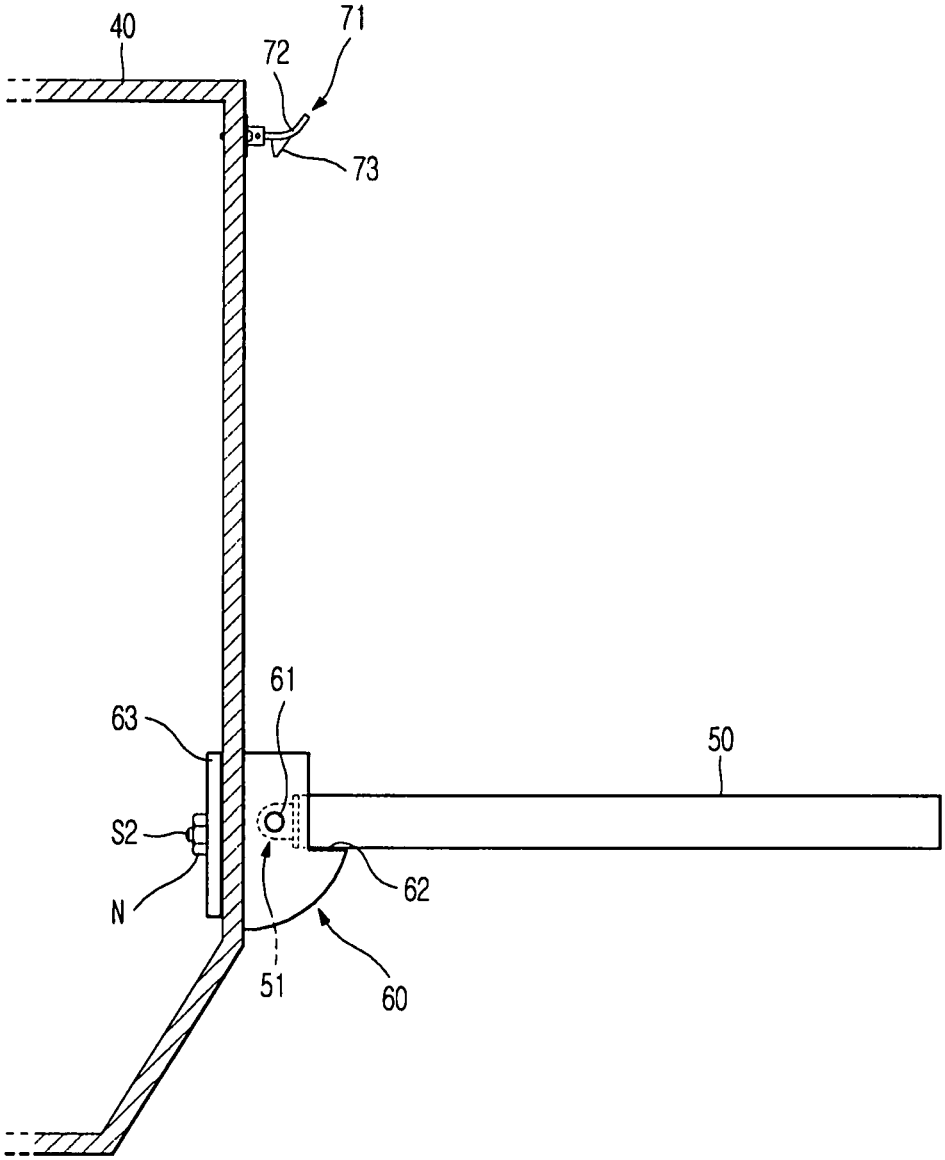

FIG. 1 schematically shows a front view of a refrigerator according to one embodiment of the present invention. FIG. 2 shows an exploded perspective view of main parts of the refrigerator according to the embodiment of the present invention. FIGS. 3 and 4 show front views of the main parts of the refrigerator according to the embodiment of the present invention.

As shown in FIG. 1, the refrigerator according to the embodiment of the present invention includes a refrigerator main body 10 including storage chambers, i.e., a cooling chamber 11 and a freezing chamber 12 for storing food products to cool and freeze them, a pair of first and second cooling chamber doors 21 and 25 to open or close the cooling chamber 11, a freezing chamber door 31 to open or close the freezing chamber 12, an ice maker 40 installed in the cooling chamber 11 to make ice, and a folding shelf 50 disposed in the cooling chamber 11.

An external appearance of the refrigerator is formed by the refrigerator main body 10 and a plurality of the doors 21, 25 and 31. Although not shown in drawings, a cool air supplying device is installed in the refrigerator main body 10.

The cool air supplying device includes a compressor, a condenser, an evaporator and a fan. The cool air supplying device supplies cool air to the cooling chamber 11 and the freezing chamber 12. The detailed configuration and operation of the cool air supplying device are the same as in a general refrigerator, and the description thereof is omitted.

A plurality of fixed shelves 13, 14, 15 and 16 for supporting food products put thereon and the ice maker 40 for making ice are installed in the cooling chamber 11. The ice maker 40 is installed at an upper edge portion of the cooling chamber 11 to ensure a storage space of the cooling chamber 11 capable of storing food products. The ice maker 40 is connected to a water supply line (not shown) for supplying water. In the fixed shelves 13, 14, 15 and 16 installed in the cooling chamber 11, the fixed shelf 16 disposed next to the ice maker 40 has a smaller size than the fixed shelves 13, 14 and 15, thereby more efficiently using a storage space of the cooling chamber 11.

The first and second cooling chamber doors 21 and 25 for opening or closing the cooling chamber 11 are rotatably installed at left and right sides of the refrigerator main body 10. The first cooling chamber door 21 has a larger size than the second cooling chamber door 25 to reduce an outflow of cool air from the cooling chamber 11 when food products are loaded into or unloaded from the cooling chamber 11. Door baskets 22 and 26 are disposed at the inner side of the cooling chamber doors 21 and 25, respectively, to store containers having a small bottom area such as bottles and cans. A dispenser 27 is disposed in the second cooling chamber door 25 for opening or closing a portion where the ice maker 40 is installed in the cooling chamber 11, thereby discharging ice made in the ice maker 40 out of the cooling chamber 11.

The freezing chamber 12 is disposed under the cooling chamber 11. The freezing chamber door 31 for opening or closing the freezing chamber 12 is a drawer-type door. When a user pulls a door handle 33 forward, the freezing chamber door 31 moves forward to open the freezing chamber 12. In this case, a food keeping box (not shown) disposed at the inner side of the freezing chamber door 31 is pulled forward together.

The folding shelf 50 is installed to be foldable at one side of the cooling chamber 11 such that food products can be put on the folding shelf 50, thereby improving efficiency of storage space utilization of the cooling chamber 11. When the folding shelf 50 is unfolded, the folding shelf 50 has the same height as the fixed shelf 16 adjacent to the folding shelf 50. As shown in FIG. 2, the folding shelf 50 is formed of a plate having a specified thickness to support food products. A shelf supporting member 60 is attached to a wall surface of the ice maker 40. The folding shelf 50 is coupled to the shelf supporting member 60 to be rotatable within a specified angle.

A pair of connecting members 51 spaced from each other is disposed at a lower portion of the folding shelf 50 to connect the folding shelf 50 to the shelf supporting member 60. The connecting members 51 have pin holes 52 which are coupled with hinge pins 61 to be described later. The connecting members 51 are attached to a lower end portion of the folding shelf 50 by coupling screws S1. An insertion groove 53 is formed at an upper end portion of the folding shelf 50 to receive a fixing protrusion 73 of a shelf fixing device 70 to be described later.

The shelf supporting member 60 for supporting the folding shelf 50 includes a pair of the hinge pins 61 disposed at opposite end portions of the shelf supporting member 60. The shelf supporting member 60 further includes a locking part 62 to support the folding shelf 50 which is unfolded to be arranged in a horizontal direction. When the folding shelf 50 is coupled to the shelf supporting member 60, the hinge pins 61 are inserted into the pin holes 52 of the connecting members 51, respectively. The locking part 62 supports the folding shelf 50 unfolded to be arranged in a horizontal direction such that the folding shelf 50 and the neighboring fixed shelf 16 have the same plane, whereby food products can be put thereon. The shelf supporting member 60 is screw-coupled to the wall surface of the ice maker 40 by coupling screws S2 and coupling nuts N. As shown in FIG. 3, a reinforcing member 63 is provided on the inner wall surface of the ice maker 40 to strongly support the shelf supporting member 60 coupled to one side surface of the ice maker 40.

On the other hand, when the folding shelf 50 is folded to be arranged in a vertical direction while being approximately perpendicular to the fixed shelves 13, 14, 15 and 16, a hook member 71 is disposed on one side surface of the ice maker 40 to hold the folding shelf 50 that is arranged vertically. As shown in FIG. 2, the hook member 71 includes a body part 72 having a front end portion which is slightly bended upward and the fixing protrusion 73 which is protruded downward from the body part 72 to be inserted into the insertion groove 53 of the folding shelf 50. The hook member 71 is hinge-connected to a hook supporting member 75 that is screw-coupled to the wall surface of the ice maker 40. The hook supporting member 75 is coupled to the wall surface of the ice maker 40 by coupling screws S3. The hook supporting member 75 has a pair of brackets 76 arranged to be spaced from each other. The brackets 76 include installation holes 77 to support a coupling shaft 78 provided for the hinge connection of the hook member 71. A supporting spring 79 is provided on the coupling shaft 78 to elastically support the hook member 71.

When the hook member 71 is connected to the hook supporting member 75, both end portions of the coupling shaft 78 pass through coupling holes 74 formed at rear end portions of the hook member 71 to be inserted into the installation holes 77 of the brackets 76. In this case, the hook member 71 is coupled to the hook supporting member 75 to be rotatable around the coupling shaft 78. The torsion spring type supporting spring 79 elastically supports the hook member 71.

Meanwhile, in this embodiment, installation positions of the hinge pins 61 and the pin holes 52 may vary. That is, the hinge pins 61 may be disposed on the connecting members 51 and the pin holes 52 may be disposed on the shelf supporting member 60. Further, the structure of the shelf fixing device 70 capable of holding the folding shelf 50 not to rotate may vary without being limited to the above-described configuration. For example, the insertion groove 53 of the folding shelf 50 may be disposed on the surface facing one side surface of the ice maker 40, and the protrusion which is inserted into the insertion groove 53 may be disposed on the ice maker 40.

Hereinafter, an operation of the folding shelf 50 of the refrigerator according to the embodiment of the present invention will be described with reference to FIGS. 3 and 4.

FIG. 3 shows the folding shelf 50 that is folded to be arranged vertically. In this case, the fixing protrusion 73 of the hook member 71 is inserted into the insertion groove 53 of the folding shelf 50 such that the folding shelf 50 does not rotate. When the folding shelf 50 is held in a vertical direction, as shown in FIG. 1, it is possible to ensure a space between the ice maker 40 and the fixed shelf 16 installed next to the ice maker 40, thereby allowing containers or food products having a great height to be stored in the space.

On the other hand, when the hook member 71 which holds the folding shelf 50 is slightly lifted upward to unfold the folding shelf 50 held in a vertical direction, the folding shelf 50 rotates by about 90 degrees. The lower surface of the folding shelf 50 is locked by the locking part 62 of the shelf supporting member 60 such that the folding shelf 50 is arranged in a horizontal direction as shown in FIG. 4. In this case, the space between the ice maker 40 and the fixed shelf 16 disposed at an uppermost portion is divided into an upper space and a lower space by the folding shelf 50, thereby putting containers or food products having a small height on the upper surface of the folding shelf 50. Since the folding shelf 50 is arranged on the same plane as the neighboring fixed shelf 16, containers or food products can be put over the folding shelf 50 and the neighboring fixed shelf 16, thereby increasing a receiving portion of the cooling chamber.

When the folding shelf 50 arranged in a horizontal direction is folded again to be arranged in a vertical direction, the folding shelf 50 is rotated counterclockwise in the drawing. Then, the body part 72 of the hook member 71 which is slightly bended upward is pushed upward by an upper end portion of the folding shelf 50, whereby the folding shelf 50 is folded in a vertical direction. In this case, the fixing protrusion 73 is inserted into the insertion groove 53 of the folding shelf 50 to suppress the rotation of the folding shelf 50.

As described above, in the refrigerator according to the present invention, the folding shelf 50 is hinge-connected to one side surface of the ice maker 40. The folding shelf 50 folded in a vertical direction can be unfolded in a horizontal direction such that food products can be put on the folding shelf 50, thereby efficiently using a storage space of the cooling chamber 11.

Meanwhile, in the refrigerator according to the present invention, the folding shelf 50 can be installed on an inner wall or another structure of the cooling chamber 11 or the freezing chamber 12 instead of the ice maker 40.

Figure 5A:
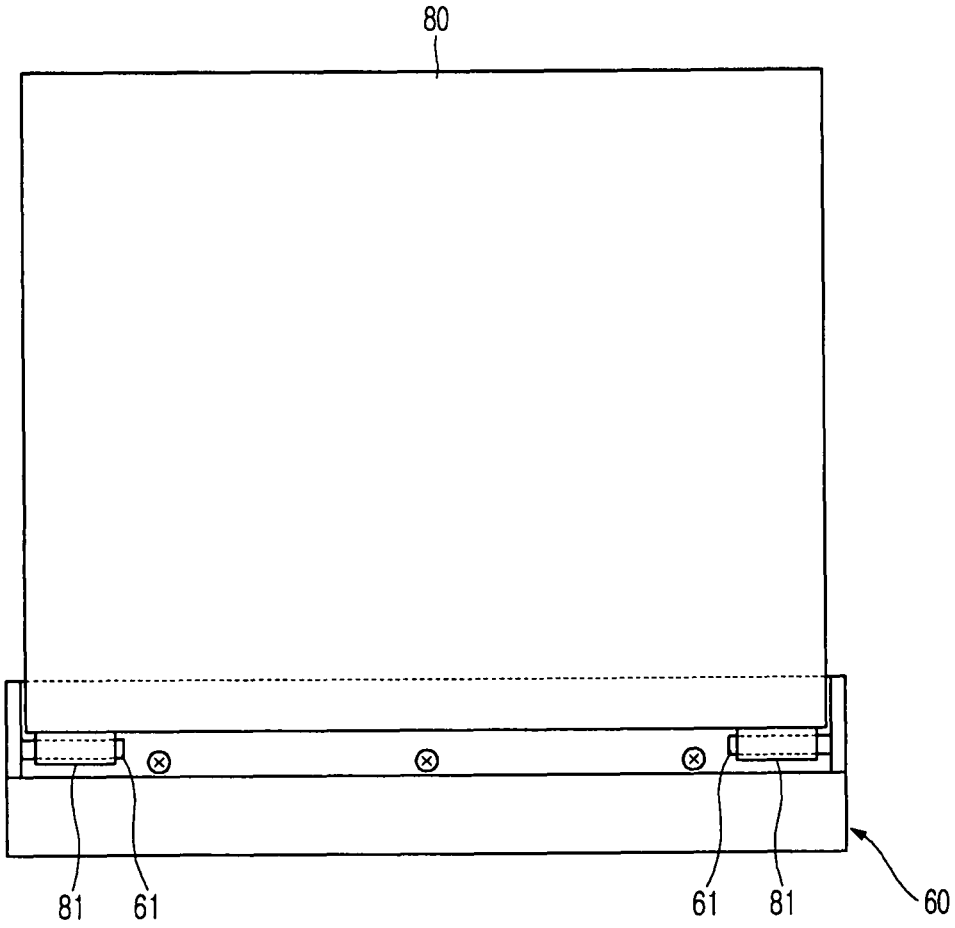
FIGS. 5A and 5B show a side view and a front view of main parts of a refrigerator according to another embodiment of the present invention, respectively.
Figure 5B:
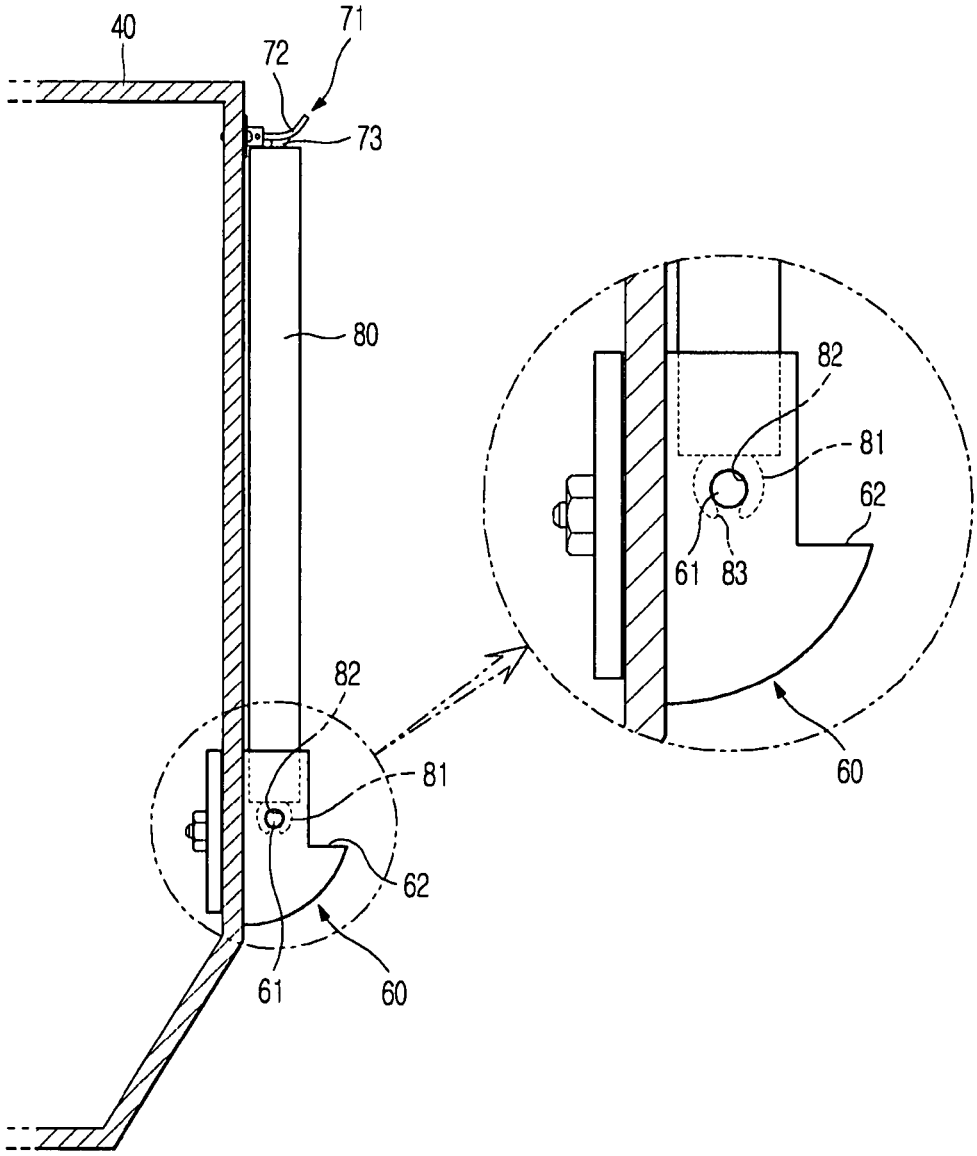

FIGS. 5A and 5B schematically show a side view and a front view of a folding shelf 80 of the refrigerator according to another embodiment of the present invention, respectively.

The folding shelf 80 shown in FIGS. 5A and 5B has the same configuration as the folding shelf 50 of the refrigerator according to the embodiment of the present invention except that the folding shelf 80 has a pair of coupling pieces 81 which are rotatably connected to the hinge pins 61 of the shelf supporting member 60 instead of the connecting members 51 connected to the hinge pins 61.

The coupling pieces 81 have coupling grooves 83 provided on one side of the coupling pieces 81 to receive the hinge pins 61, respectively. The coupling pieces 81 further have coupling surfaces 82 corresponding to outer surfaces of the hinge pins 61, respectively. As shown in FIG. 5B, the coupling pieces 81 have an arc-shaped section such that the coupling surfaces 82 are stuck to outer peripheral surfaces of the hinge pins 61. Accordingly, the coupling pieces 81 cannot be easily separated from the hinge pins 61.

In the same way as the folding shelf 50, the folding shelf 80 arranged in a vertical direction is held by the hook member 71 such that the folding shelf 80 does not rotate. When the folding shelf 80 is arranged in a horizontal direction while the folding shelf 80 and the neighboring fixed shelf 16 (see FIG. 1) have the same plane, the folding shelf 80 is supported by the locking part 62 of the shelf supporting member 60. Since the other parts except the coupling pieces 81 have the same configuration as those in the above-described embodiment, detailed description of their configuration and operation is omitted.

In this embodiment, installation positions of the hinge pins 61 and the coupling pieces 81 may vary. That is, the hinge pins 61 may be disposed on folding shelf 80 and the coupling pieces 81 may be disposed on the shelf supporting member 60.

FIGS. 6 to 9 show a folding shelf 110 of the refrigerator according to yet another embodiment of the present invention.

The folding shelf 110 of the refrigerator according to yet another embodiment of the present invention is installed on the wall surface of the ice maker 40 to rotate within about 90 degrees in the same way as the folding shelves 50 and 80 of the above two embodiments. However, the folding shelf 110 can be held in a folded state without the shelf fixing device.

Figure 6:
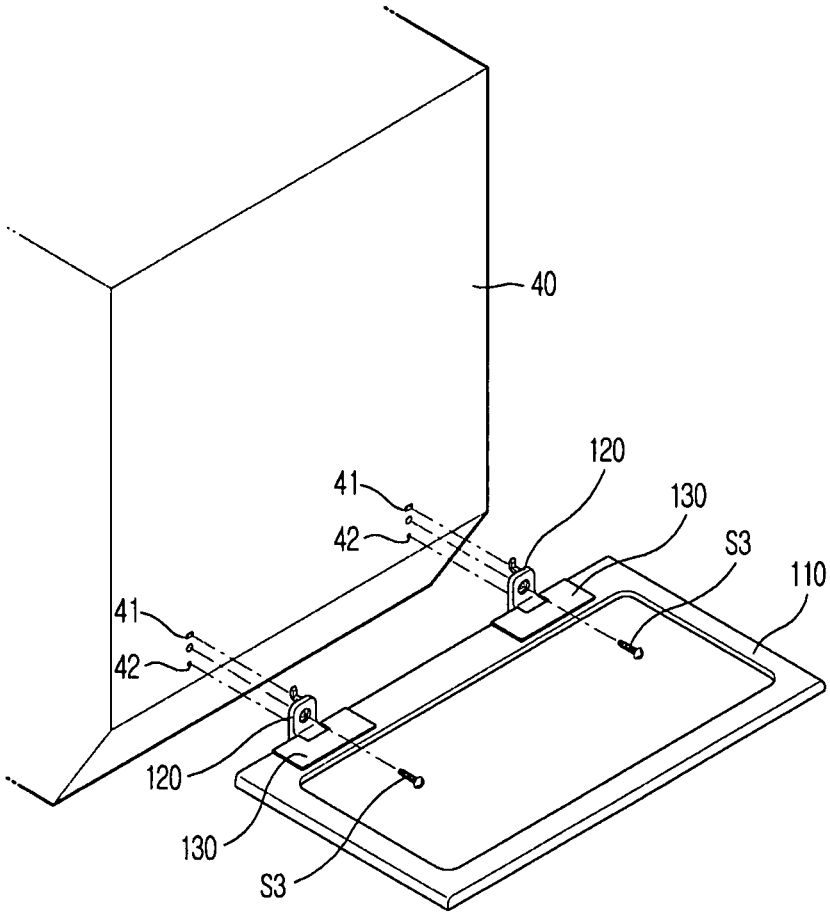
FIG. 6 shows an exploded perspective view of main parts of a refrigerator according to yet another embodiment of the present invention.

As shown in FIG. 6, the folding shelf 110 according to this embodiment is coupled to the ice maker 40 to be rotatable within a specified angle by a pair of shelf supporting members 120 and a pair of connecting members 130. The shelf supporting members 120 are coupled to the ice maker 40 by coupling screws S3. The connecting members 130 coupled to the folding shelf 110 are coupled to the shelf supporting members 120 to be rotatable within a specified angle.

Figure 7:
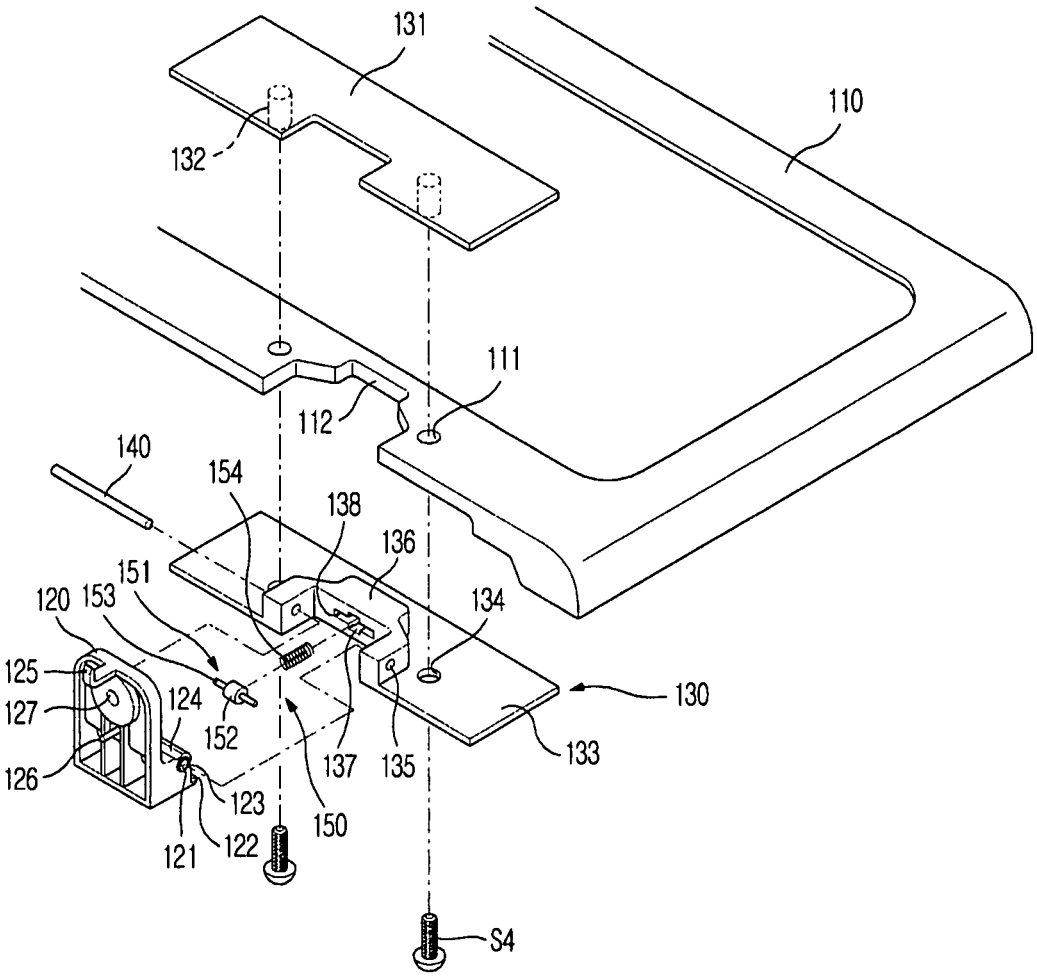
FIG. 7 shows an exploded perspective view of a folding shelf of the refrigerator shown in FIG. 6 according to yet another embodiment of the present invention.

As shown in FIG. 7, the shelf supporting members 120 have through-holes 121 to receive hinge pins 140, respectively. Each of the connecting members 130 has a pair of pin holes 135 to receive both end portions of each hinge pin 140 which are protruded from both sides of each through-hole 121. The connecting members 130 are coupled to hinge pins 140 coupled to the shelf supporting members 120, whereby the connecting members 130 can rotate around the hinge pins 140 by about 90 degrees. Contact devices 150 are installed between the shelf supporting members 120 and the connecting members 130, respectively, to suppress the rotation of the connecting members 130. The contact devices 150 include contact members 151 and pressing springs 154, respectively. The pressing springs 154 are coupled to the connecting members 130 and the contact members 151 are supported by the pressing springs 154. Each shelf supporting member 120 and each connecting member 130 are pressed in directions in which they are separated from each other by each contact member 151 and each pressing spring 154. Accordingly, the connecting members 130 cannot easily rotate with respect to the shelf supporting members 120. The detailed structure and operation of the contact members 151 and the pressing springs 154 will be described later.

The shelf supporting members 120 include locking parts 122 disposed at front lower portions thereof to support the connecting members 130 when the connecting members 130 coupled to the folding shelf 110 rotate to a horizontal position. The locking parts 122 are formed to be protruded from the front lower portions of the shelf supporting members 120. That is, each locking part 122 and each shelf supporting member 120 are formed as a single body. A first locking groove 123 and a second locking groove 124 are formed at a front portion of each shelf supporting member 120 to receive an contact part 152 of each contact member 151. The first locking groove 123 receives the contact member 151 when the folding shelf 110 is unfolded in a horizontal direction. The second locking groove 124 receives the contact member 151 when the folding shelf 110 is folded in a vertical direction. The contact part 152 of each contact member 151 is received in the first locking groove 123 or the second locking groove 124 when the folding shelf 110 is arranged in a horizontal direction or a vertical direction. Thus, it is possible to further suppress the rotation of the folding shelf 110 arranged in a horizontal direction or a vertical direction.

Further, first and second temporary coupling members 125 and 126 are formed to be protruded backward from the shelf supporting members 120 to temporarily assemble the shelf supporting members 120 and the ice maker 40. First, the shelf supporting members 120 and the connecting members 130 are coupled to the folding shelf 110. Then, the supporting members 120 are screw-connected to the ice maker 40. Before the shelf supporting members 120 are fixed to the ice maker 40 by the coupling screws S3, the first and second temporary coupling members 125 and 126 of the shelf supporting members 120 are inserted into first and second temporary coupling grooves 41 and 42 formed on the ice maker 40, thereby temporarily coupling the shelf supporting members 120 with the ice maker 40. Accordingly, it is possible to easily perform an assembly operation of the shelf supporting members 120. The first temporary coupling members 125 are formed to be protruded backward from upper portions of the shelf supporting members 120. The second temporary coupling members 126 are formed to be protruded backward from middle portions of the shelf supporting members 120. The first temporary coupling members 125 have end portions which are bended by about 90 degrees such that the first temporary coupling members 125 cannot be easily separated from the first temporary coupling grooves 41. The shelf supporting members 120 have insertion holes 127 which the coupling screws S3 are inserted into.

The connecting members 130 are coupled to one end portion of the folding shelf 110 and include first and second coupling covers 131 and 133. The coupling covers 131 and 133 are connected with each other by coupling screws S4 while the folding shelf 110 is inserted between the coupling covers 131 and 133. The first coupling covers 131 are coupled to the upper surface of the folding shelf 110 and the second coupling covers 133 are coupled to the lower surface of the folding shelf 110. Screw-coupling bosses 132 and screw-coupling holes 134 are formed on the first and second coupling covers 131 and 133, respectively, to clamp the coupling screws S4. Further, each of the second coupling covers 133 includes a pair of pin holes 135 to receive a hinge pin 140 and a spring receiving portion 136 to receive the pressing spring 154. The spring receiving portion 136 includes a receiving groove 137 to receive the pressing spring 154 and a portion of the contact member 151 and a shaft supporting groove 138 to receive a support shaft 153 of the contact member 151.

The folding shelf 110 includes connecting holes 111 to receive the screw-coupling bosses 132 and coupling grooves 112 corresponding to the spring receiving portions 136 to couple the first coupling covers 131 with the second coupling covers 133. The first coupling covers 131 are coupled to the upper surface of the folding shelf 110 such that the screw-coupling bosses 132 are inserted into the connecting holes 111 of the folding shelf 110. The second coupling covers 133 are coupled to the lower surface of the folding shelf 110 such that the coupling grooves 112 correspond to the spring receiving portions 136. Then, the coupling screws S4 are inserted into the screw-coupling bosses 132 through the screw-coupling holes 134, thereby fixing the first and second coupling covers 131 and 133 to the folding shelf 110.

The pressing springs 154 are inserted into the receiving grooves 137 of the second coupling covers 133. Portions of the contact members 151 are inserted into the receiving grooves 137 such that a pressing force is applied to the contact members 151 by the pressing springs 154. The contact members 151 have a roller shape. The support shaft 153 is provided to be protruded from both end portions of the contact member 151. The support shaft 153 is supported by being inserted into the shaft supporting groove 138, thereby allowing the rotation of the contact members 151.

Figure 8A:
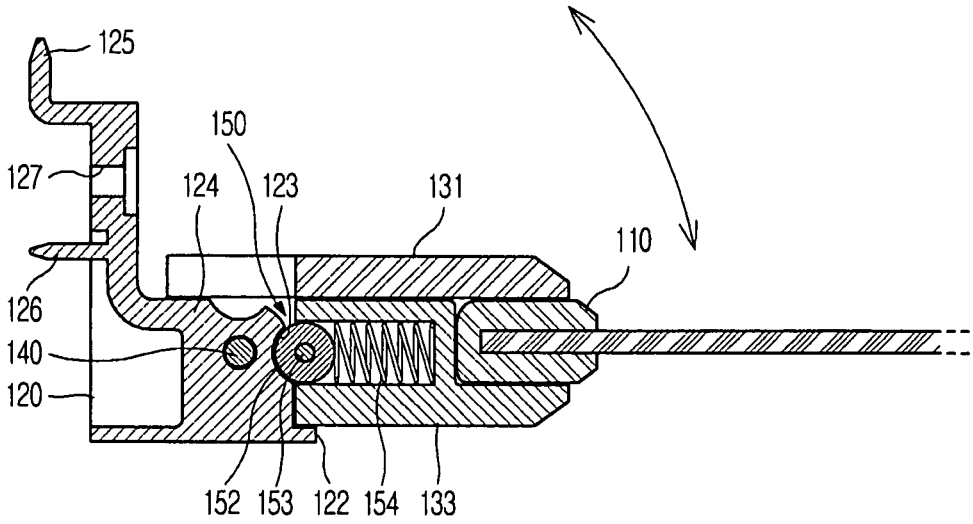
FIGS. 8A and 8B show side cross-sectional views for explaining an operation of the folding shelf of the refrigerator shown in FIG. 6 according to yet another embodiment of the present invention.

As shown in FIG. 8A, when the folding shelf 110 is arranged in a horizontal direction, the contact members 151 are inserted into the first locking grooves 123. In this case, the contact members 151 are pressed toward the shelf supporting members 120 by the pressing springs 154. The shelf supporting members 120 and the connecting members 130 are subject to forces exerted in directions in which they are separated from each other, thereby suppressing the rotation of the connecting members 130. Thus, if an external force is not applied to the folding shelf 110 coupled to the connecting members 130, the folding shelf 110 does not rotate. Further, if an external force is not applied to the folding shelf 110 arranged in a vertical direction, the folding shelf 110 can be held in a folded state.

Figure 8B:
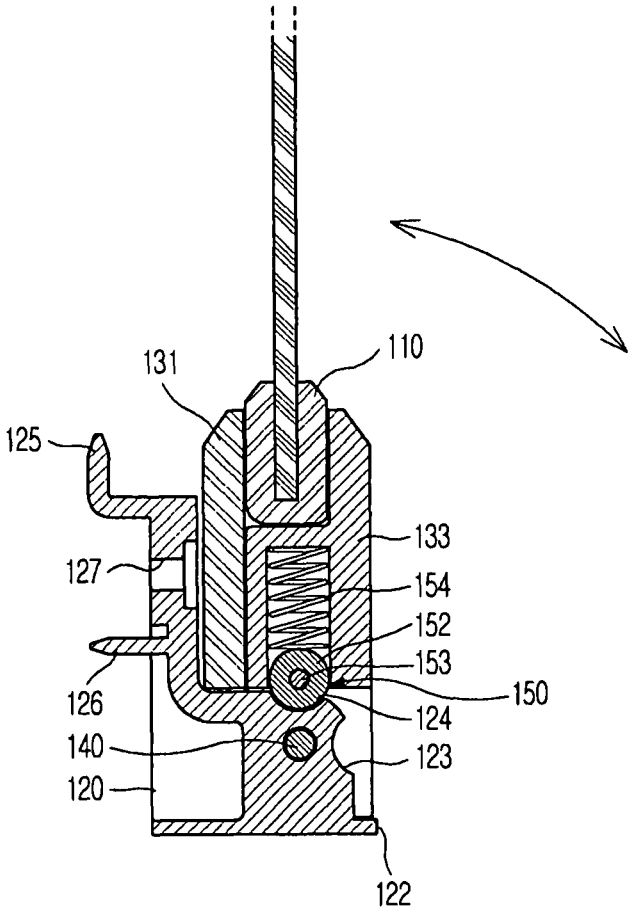

Further, as shown in FIG. 8B, when the folding shelf 110 is folded in a vertical direction, the contact members 151 are inserted into the second locking grooves 124. In this case, the contact members 151 are pressed toward the shelf supporting members 120 by the pressing springs 154, thereby suppressing the rotation of the connecting members 130. Accordingly, the contact members 151 cannot be easily separated from the second locking grooves 124. Thus, if an external force is not applied to the folding shelf 110, the folding shelf 110 arranged in a vertical direction can be held in a folded state.

As describe above, the folding shelf 110 according to yet another embodiment of the present invention can be held while being arranged in a vertical direction or a horizontal direction without an additional shelf fixing device.

Figure 9:
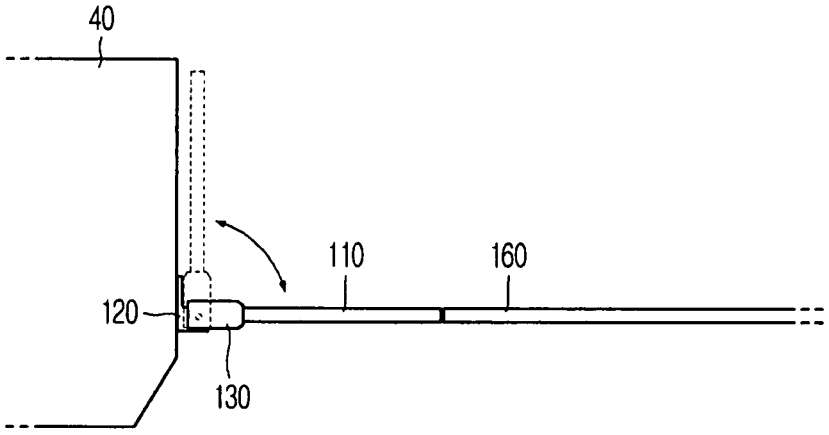
FIG. 9 shows a front view for explaining the operation of the folding shelf of the refrigerator shown in FIG. 6 according to yet another embodiment of the present invention.

In this embodiment, as shown in FIG. 9, when the folding shelf 110 is unfolded to be positioned in a horizontal direction, the folding shelf 110 and a neighboring fixed shelf 160 have the same plane, thereby putting products thereon. Further, when the folding shelf 110 is folded to be positioned in a vertical direction, it is possible to ensure a space between the ice maker 40 and the fixed shelf 160 where products having a great height can be put.

Although the contact devices 150 have a structure in which the contact members 151 are elastically supported by the pressing springs 154 in this embodiment, the structure of the contact devices 150 is not limited thereto. The contact devices 150 may be formed of an elastic body which is supported by the connecting members 130 to press the shelf supporting members 120. Further, the pressing springs 154 and the contact members 151 may be disposed at the shelf supporting members 120 which are fixed on the ice maker 40. In this case, the contact parts 152 of the contact members 151 have a great diameter and a large outer peripheral surface such that the connecting members 130 can be pressed by the contact parts 152 while the connecting members 130 rotate within a specified angle. Further, the connecting members 130 may include grooves having a curvature corresponding to a curvature of the contact parts 152.

In the above-described refrigerator according to the present invention, the folding shelves 50, 80 and 110 can be installed on another inner wall of the cooling chamber 11 or the freezing chamber 12 instead of the wall surface of the ice maker 40.

According to the present invention, the folding shelf is installed in the storage chamber of the refrigerator to be rotatable within a specified angle. When the folding shelf is folded in a vertical direction, there is formed a space capable of storing containers or food products having a great height. When the folding shelf is unfolded in a horizontal direction, containers or food products having a small height can be put on the folding shelf. Thus, it is possible to more efficiently use a storage space of the refrigerator, particularly, a storage space formed on the side of the ice maker.

Further, according to the present invention, the folding shelf can be stably positioned in a vertical direction or a horizontal direction.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator comprising:

a main body having a storage chamber to store food;

an ice maker disposed in an upper corner of the storage chamber a folding shelf disposed at a vertical wall of the ice maker to be folded in a vertical direction or unfolded in a horizontal direction;

a shelf supporting member fixed to the vertical wall of the ice maker;

a connecting member disposed at the folding shelf to be hinge-connected to the shelf supporting member;

a contact member disposed between the shelf supporting member and the connecting member while being elastically supported by a pressing spring to press the contact member toward the shelf supporting member such that the contact member is movable forward and rearward;

a contact member contact surface provided at the shelf supporting member to allow the contact member to slide along the contact member contact surface while coming into contact with the contact member contact surface when the folding shelf rotates; and a locking part extending from the contact surface to support the connecting member when the folding shelf is arranged in a horizontal direction, wherein the contact member contact surface includes a first locking groove to receive the contact member when the folding shelf is arranged in a vertical direction, a second locking groove to receive the contact member when the folding shelf is arranged in a horizontal direction, and a contact surface between the first locking groove and the second locking groove to allow the contact member to slide along the contact surface, a pair of temporary coupling grooves provided at the vertical wall of the ice maker to temporarily couple the shelf supporting member to the vertical wall of the ice maker, a pair of temporary coupling members provided at the shelf supporting member to be inserted into the temporary coupling grooves, and one of the temporary coupling members has a bent portion to engage with one of the temporary coupling grooves, so as to prevent the shelf supporting member temporarily coupled to the vertical wall from being separated from the vertical wall.

2. The refrigerator according to claim 1, further comprising:

a first fixed shelf to be positioned adjacent to the folding shelf when the folding shelf is unfolded;

a second fixed shelf disposed beneath the first fixed shelf;

a first storage space defined by the first fixed shelf; and a second storage space defined by the second fixed shelf, wherein a space adjacent to the vertical wall of the ice maker includes a third storage space defined by the folding shelf when the folding shelf is unfolded in a horizontal direction.

3. The refrigerator according to claim 1, wherein:

the shelf supporting member is coupled to the vertical wall of the ice maker by a fastening member after being temporarily coupled to the vertical wall of the ice maker; and a reinforcing member is provided inside the vertical wall of the ice maker, to reinforce the vertical wall to which the shelf supporting member is coupled.

4. A refrigerator comprising:

a main body having a storage chamber to store food;

an ice maker disposed in an upper corner of the storage chamber a folding shelf disposed at a vertical wall of the ice maker to be folded in a vertical direction or unfolded in a horizontal direction;

a shelf supporting member fixed to the vertical wall of the ice maker;

a connecting member disposed at the folding shelf to be hinge-connected to the shelf supporting member;

a contact member disposed between the shelf supporting member and the connecting member while being elastically supported by a pressing spring to press the contact member toward the shelf supporting member such that the contact member is movable forward and rearward;

a contact member contact surface provided at the shelf supporting member to allow the contact member to slide along the contact member contact surface while coming into contact with the contact member contact surface when the folding shelf rotates; and a locking part extending from the contact surface to support the connecting member when the folding shelf is arranged in a horizontal direction, wherein the contact member contact surface includes a first locking groove to receive the contact member when the folding shelf is arranged in a vertical direction, a second locking groove to receive the contact member when the folding shelf is arranged in a horizontal direction, and a contact surface between the first locking groove and the second locking groove to allow the contact member to slide along the contact surface, the contact member includes a roller to move along the contact member contact surface, and a pair of supporting shafts protruded from opposite sides of the roller, and the connecting member is provided with a receiving groove to receive the pressing spring and the roller, and shaft supporting grooves to receive the support shafts.

5. A refrigerator comprising:

a main body having a storage chamber to store food;

a door to open and close the storage chamber and having a dispenser;

an ice maker disposed in an upper corner of the storage chamber;

a shelf supporting member fixed to a vertical wall of the ice maker;

a folding shelf rotatably coupled to the shelf supporting member to be folded in a vertical direction or unfolded in a horizontal direction;

a connecting member disposed at the folding shelf to be hinge-connected to the shelf supporting member; and a contact device disposed between the shelf supporting member and the connecting member while being supported by the connecting member and being contacted to the shelf supporting member to suppress rotation of the connecting member, wherein the contact device includes a pressing spring supported by the connecting member, and a contact member supported by the pressing spring to be pressed and contacted to the shelf supporting member, wherein the connecting member includes: a receiving groove to receive the contact member while allowing the contact member to move forward and rearward, wherein the shelf supporting member includes a contact member contact surface to which the contact member is pressed and contacted, the contact member contact surface includes a first locking groove to receive the contact member when the folding shelf is folded in a vertical direction, and a second locking groove to receive the contact member when the folding shelf is unfolded in a horizontal direction after crossing the first locking groove, the contact member includes a roller supported by the pressing spring received in the receiving groove, to move along the contact member contact surface, and a pair of supporting shafts protruded from opposite sides of the roller, and the receiving groove includes shaft supporting grooves to receive the support shafts while allowing the support shafts to move forward and rearward.

6. The refrigerator according to claim 5, wherein:

the shelf supporting member is coupled to the vertical wall of the ice maker by a fastening member; and a reinforcing member is provided inside the vertical wall of the ice maker, to be coupled with the fastening member so as to reinforce the vertical wall to which the shelf supporting member is coupled.

* * * * *